United States Patent [19]

Jahnke et al.

[11] Patent Number: 4,533,363

[45] Date of Patent: Aug. 6, 1985

[54] PRODUCTION OF SYNTHESIS GAS

[75] Inventors: Frederick c. Jahnke, Rye; William B. Crouch, Chappaqua, both of N.Y.

[73] Assignee: Texaco Development Corporation, White Plains, N.Y.

[21] Appl. No.: 572,288

[22] Filed: Jan. 20, 1984

[51] Int. Cl.[3] ..... C10J 3/46

[52] U.S. Cl. ..... 48/197 R; 48/69; 252/373

[58] Field of Search ..... 48/197 R, 69; 252/373

[56] References Cited

U.S. PATENT DOCUMENTS

| | | | |
|---|---|---|---|
| 3,018,174 | 1/1962 | Steever | 48/63 |
| 4,425,139 | 1/1984 | Schmidt et al. | 48/69 |
| 4,465,496 | 8/1984 | Suggitt | 48/197 R |

FOREIGN PATENT DOCUMENTS

| | | | |
|---|---|---|---|
| 3230088 | 2/1984 | Fed. Rep. of Germany | 48/197 R |

*Primary Examiner*—Peter Kratz

*Attorney, Agent, or Firm*—Robert A. Kulason; Carl G. Seutter

[57] ABSTRACT

Synthesis gas prepared from ash-containing carbonaceous fuel is passed to a water-containing contact zone wherein the ash is collected in a lower settling portion of the contact zone prior to passage through a valved passageway and thence to a lock hopper during a valve-open period, flow of said ash being augmented by intermittent positive flow of water during the time said valve is open, through said valve from said settling zone to said lock hopper whereby more positive flow of ash is obtained (when compared to that obtained by use of continuous flow of water from the lock hopper) with substantially decreased heat loss.

6 Claims, 1 Drawing Figure

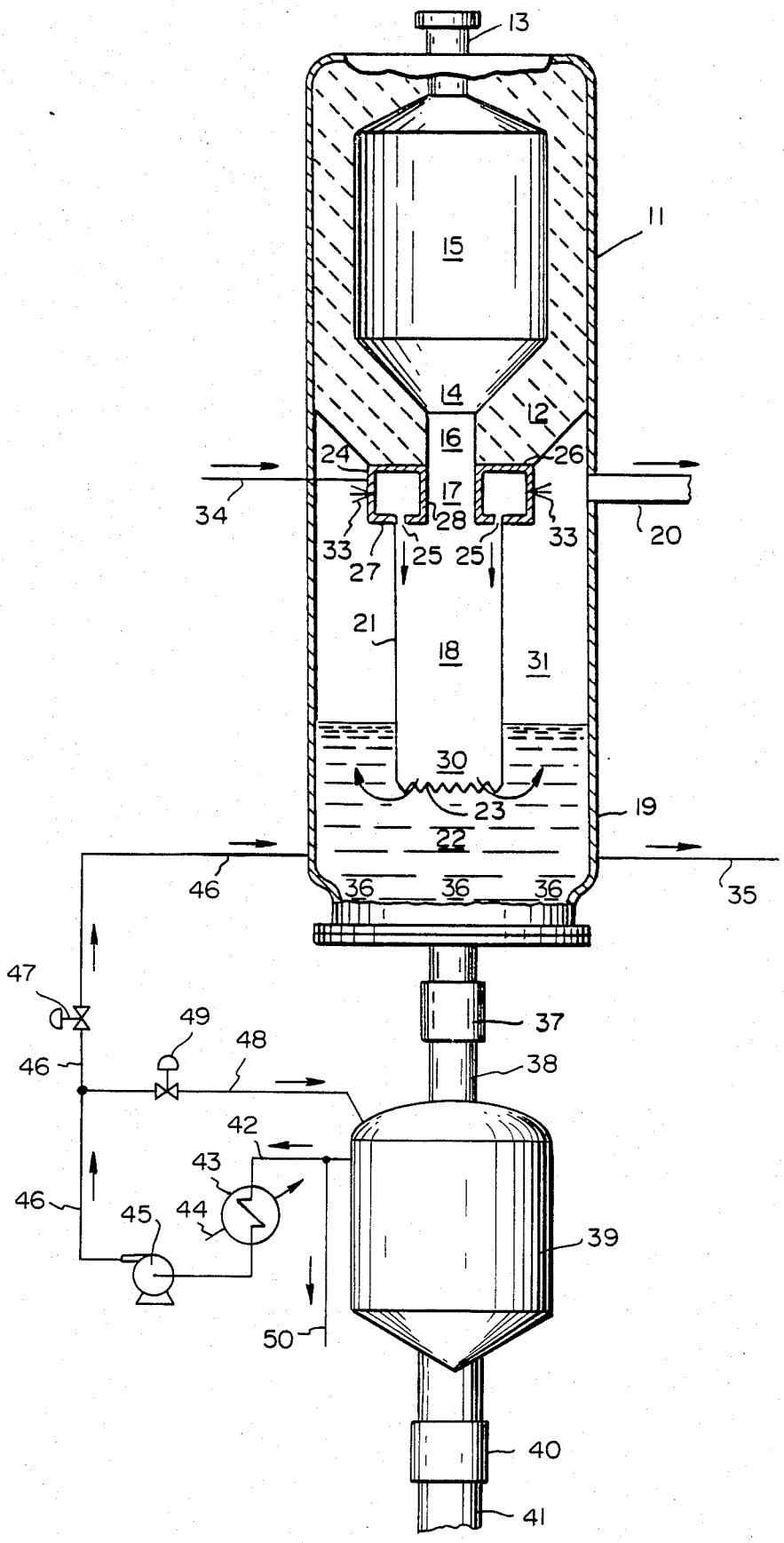
13
11
15
14
12
16
24
26
17
34
28
20
33
33
27
25
25
21
18
31
30
23
19
22
46
36
36
36
35
47
49
37
48
46
38
42
43
46
44
45
39
50
40
41

PRODUCTION OF SYNTHESIS GAS

FIELD OF THE INVENTION

This invention relates to the production of synthesis gas. More particularly it relates to the production of synthesis gas from an ash-containing carbonaceous charge under conditions which augment the passage of ash from a settling zone to an ash collection zone in a lock hopper.

BACKGROUND OF THE INVENTION

As is well known to those skilled in the art, synthesis gas may be prepared from ash-containing carbonaceous fuel including liquid or solid charge materials. When the charge is characterized by a high ash content as may be the case with residual liquid hydrocarbons or solid carbonaceous fuels such as coals of low rank, the high ash content poses an additional burden. The ash must be separated from the product synthesis gas; and the large quantities of ash build up in the system, particularly in the settling zone, unless special techniques are provided to minimize or to eliminate this.

It is an object of this invention to provide a process for producing synthesis gas under conditions wherein build-up of ash in the settling zone is kept within acceptable limits while penalties and costs of ash removal are minimized. Other objects will be apparent to those skilled in the art.

STATEMENT OF THE INVENTION

In accordance with certain of its aspects, this invention is directed to a process for the production of synthesis gas from an ash-containing carbonaceous fuel which comprises gasifying said fuel in finely divided form in a gasification zone at superatmospheric pressure to produce a product synthesis gas containing particles of ash and unconverted fuel;

passing said particles of ash and unconverted fuel into water contained in a settling zone and in a lock hopper having a narrow valved connecting passageway therebetween, said ash and unconverted fuel during settling tending to collect in the lower portion of the settling zone and to block the passageway and thereby prevent the passage of said particles of ash and unconverted fuel from the lower portion of said settling zone into said passageway and thence into said lock hopper;

intermittently opening the valve in said connecting passageway thereby permitting the particles to pass through said valved passageway during a valve-open period; and, intermittently, during said valve-open period, passing water through said valve from said settling zone into said lock hopper at a pressure higher than that in the lock hopper in order to increase the flow of water leaving the lower portion of said settling zone, passing through said valved passageway, and entering said lock hopper, thereby increasing the velocity and quantity of water passing through said valved passageway whereby positive flow of said particles is effected through said passageway during said valve-open period in which said valve in said valved passageway is open.

DESCRIPTION OF THE INVENTION

The synthesis gas which may be prepared by the process of this invention may be prepared by the gasification of coal. In a typical coal gasification process, the charge coal which has been finely ground typically to an average particle size of 20–500 microns, preferably 30–300, say 200 microns, may be slurried with an aqueous medium, typically water, to form a slurry containing 40–80 w %, preferably 50–75 w %, say 60 w % solids. The aqueous slurry may then be admitted to a combustion chamber wherein it is contacted with oxygen-containing gas, typically air or oxygen, to effect combustion. The atomic ratio of oxygen to carbon in the system may be 0.7–1.2:1, say 0.9:1. Typically reaction is carried out at 1800° F.–2800° F., say 2500° F. and pressure of 100–1500 psig, preferably 500–1200, say 900 psig.

The synthesis gas may alternatively be prepared by the incomplete combustion of liquid hydrocarbon such as residual fuel oil, asphalt, etc. or of a solid carbonaceous material such as coke from petroleum or from tar sands, bitumen carbonaceous residues from coal hydrogenation processes, etc.

The apparatus which may be used in practice of this invention may include a gas generator such as is generally set forth in the following patents inter alia:

U.S. Pat. No. 2,818,326 Eastman et al.
U.S. Pat. No. 2,896,927 Nagle et al
U.S. Pat. No. 3,998,609 Crouch et al.
U.S. Pat. No. 4,218,423 Robin et al.

Effluent from the reaction zone in which charge is gasified to produce synthesis gas may be at a temperature of 1800° F.–2800° F., say 2500° F. at 100–1500 psig, preferably 500–1200 psig, say 900 psig.

Under these typical conditions of operation, the synthesis gas commonly contains (dry basis) 35–55 v %, say 44.7 v % carbon monoxide, 30–45 v %, say 35.7 v % hydrogen; 10–20 v %, say 18 v %. carbon dioxide, 0.3 v %–2 v %, say 1 v % hydrogen sulfide plus COS; 0.4–0.08 v %, say 0.5 v % nitrogen + argon; and methane in amount less than about 0.1 v %.

When the fuel is a solid carbonaceous material, the unscrubbed product synthesis gas may commonly contain solids (including ash, char, slag, etc) in amount of 1–10 pounds, say 4 pounds per thousand SCF of dry product gas; and these solids may be present in particle size of less than 1 micron up to 3000 microns. The charge coal may contain ash in amount as little as 0.5 w % or as much as 40 w % or more. This ash is found in the product synthesis gas. Although the improved process of this invention will provide some benefit when the synthesis gas contains small amounts of ash, it is found to be particularly advantageous when the gas contains solids in amount of 3% or more.

The hot synthesis gas at this initial temperature of 1800° F.–2800° F., say 2500° F. is passed downwardly through a first contacting zone. The upper extremity of the first contacting zone may be defined by the lower outlet portion of the reaction chamber of the gas generator. The first contacting zone may be generally defined by an upstanding preferably vertical perimeter wall forming an attenuated conduit, and the cross-section of the zone formed by the wall is in the preferred embodiment substantially cylindrical. The outlet or lower end of the attenuated conduit or dip tube at the lower extremity of the preferably cylindrical wall preferably bears a serrated edge.

The first contacting zone is preferably bounded by the upper portion of a vertically extending, cylindrical dip tube which has its axis colinear with respect to the combustion chamber.

At the upper extremity of the first contacting zone in the dip tube, there is mounted a quench ring through which cooling liquid, commonly water, is admitted to the first contacting zone. From the quench ring, there is directed a first stream of cooling liquid along the inner surface of the dip tube on which it forms a preferably continuous downwardly descending film of cooling liquid which is in contact with the downwardly descending synthesis gas. Inlet temperature of the cooling liquid may be 100° F.–500° F., preferably 300° F.–480° F., say 420° F. The cooling liquid is admitted to the falling film on the wall of the dip tube in amount of 20–120, preferably 30–100, say 85 pounds per thousand SCF of gas admitted to the first contacting zone.

The cooling liquid admitted to the contacting zones, and particularly that admitted to the quench ring, may include recycled liquids which have been treated to lower their solids content.

As the falling film of cooling liquid contacts the downwardly descending hot synthesis gas, the temperature of the latter may drop by 200° F.–400° F., preferably 300° F.–400° F., say 300° F. because of contact with the falling film during its passage through the first contacting zone.

The gas may pass through the first contacting zone for 0.1–1 seconds, preferably 0.1–0.5 seconds, say 0.3 seconds at a velocity of 6–30, say 20 ft/sec. Gas exiting this first zone may have a reduced solids content, and be at a temperature of 1400° F.–2300° F., say 2200° F.

The gas leaves the lower extremity of the first contacting zone and passes into a second contacting zone wherein it contacts a body of cooling liquid. In this second contacting zone, the gas passes under a serrated edge of the dip tube.

The lower end of the dip tube is submerged in a pool of liquid formed by the collected cooling liquid which defines the second contacting zone. The liquid level, when considered as a quiescent pool, may typically be maintained at a level such that 10%–80%, say 50% of the second contacting zone is submerged. It will be apparent to those skilled in the art that at the high temperature and high gas velocities encountered in practice, there may of course be no identifiable liquid level during operation—but rather a vigorously agitated body of liquid.

The further cooled synthesis gas leaves the second contacting zone at typically 600° F.–900° F., say 800° F. and it passes through the body of cooling liquid in the second contacting zone and under the lower typically serrated edge of the dip tube. The solids fall through the body of cooling liquid wherein they are retained and collected and may be drawn off from a lower portion of the body of cooling liquid.

Commonly the gas leaving the second contacting zone may have had 75% or more of the solids removed therefrom.

The further cooled gas at 600° F.–900° F., say 800° F. leaving the body of cooling liquid which constitutes the second contacting zone is preferably passed together with cooling liquid upwardly through a preferably annular passageway through a third contacting zone toward the gas outlet of the quench chamber. In one embodiment, the annular passageway is defined by the outside surface of the dip tube forming the first cooling zone and the inside surface of the vessel which envelops or surrounds the dip tube and which is characterized by a larger radius than that of the dip tube.

In an alternative embodiment, the annular passageway may be defined by the outside surface of the dip tube forming the first and second contacting zone and the inside surface of a circumscribing draft tube which envelopes or surrounds the dip tube and which is characterized by larger radius than that of the dip tube.

As the mixture of cooling liquid and further cooled synthesis gas (at inlet temperature of 600° F.–900° F., say 800° F.) passes upwardly through the annular third cooling zone, the two phase flow therein effects efficient heat transfer from the hot gas to the cooling liquid: the vigorous agitation in this third cooling zone minimizes deposition of the particles on any of the contacted surfaces. Typically the cooled gas exits this annular third contacting zone at temperature of 350° F.–600° F., say 500° F. The gas leaving the third contacting zone contains 0.1–2.5, say 0.4 pounds of solids per 1000 SCF of gas i.e. about 85%–95% of the solids will have been removed from the gas.

The solids, including particles of ash, char, and unconverted fuel which are removed from the synthesis gas during contact with water in the contacting zone are passed downwardly into a settling zone in the lower portion of the contacting zone. Here the particles accumulate. Intermittently they may be withdrawn through a first valved passageway during a valve-open period and passed to a lock hopper wherein the solids accumulate. Typically the material fed to the lock hopper may contain 10–50 parts of solid, say 30 parts of solid per 100 parts of water. The pressure in the lock hopper may typically be 100–1500 psig, say 900 psig and the temperature at 100° F.–210, say 180° F. Solids may be withdrawn from the bottom of the lock hopper through a second valved passageway and withdrawn from system.

In practice of the process of this invention, the first valve in the first valved passageway between the settling zone and the lock hopper may be intermittently opened to permit collected ash-solids in the settling zone to pass to the lock hopper during this valve-open period. The frequency and duration of the period during which the first valve is opened may vary depending on the amount and nature of the solids present. Each cycle of the valve (including the periods during which it is open and closed) may typically be 5–30 minutes, preferably 10–25 minutes, say 20 minutes. During each cycle, the valve may typically be open for 50%–95%, preferably 90%–95%, say 95% of the total time i.e. for 2.5–29 minutes, preferably 4–29 minutes, say 19 minutes.

When the high ash solid fuels are employed, the first valve may typically be intermittently opened for 4–19 minutes, say 19 minutes of the total cycle time of 5–20 minutes, say 20 minutes.

It is a feature of the process of this invention that during the time when the first valve is open, water is intermittently passed from the settling zone, at a pressure higher than that in the lock hopper, into the lock hopper. In one embodiment, the water balance may be maintained by withdrawing water from the lock hopper. In a preferred embodiment, water is typically recycled from the lock hopper to the settling zone externally through a recycle pump. The recycled water may be cooled. This withdrawn stream insures that a positive flow of liquid moves from the settling zone, through the first valved passageway, and into the lock hopper. (In the absence of this positively moving stream, the flow of particles through the first valved passageway is essentially by gravity and the downward flow of liquid is minimal. In fact there may be a net upflow of liquid as the downwardly moving particles displace liquid.) The downward positive flow of liquid may typically be at average velocity of 1–50 feet per minute, say 10 feet per minute. This flow draws even the very finest particles in the settling zone into the lock hopper.

The flow of water which is admitted to the lock hopper during the valve-open period when the valve is open in the first valved passageway may be controlled at a predetermined rate which is varied.

In one embodiment, it may be varied in a manner to provide a sinusoidal flow of water. In this instance, the flow may vary periodically from zero to a maximum, this being repeated at intervals of 1–10 minutes, say 2 minutes over the total time of 15–30 minutes, say 20 minutes during which the first valve is open (the valve-open period).

In another embodiment, the flow may be a step flow in which during the time the first valve is open, the flow may first be at a high level sufficient to yield a linear velocity through the first valve of 1–50 feet per minute, say 10 feet per minute for 5%–80%, say 20% of the time that the valve is open followed by a flow at a lower level sufficient to yield a linear velocity through the first valve of 0–2 feet per minute, say 0.1 feet per minute for 20%–95%, say 80% of the time that the valve is open. In this step flow embodiment, the velocity during each step, the number of steps, and the duration of each step will depend upon the quantity and properties of the ash deposited in the settling chamber.

It is a feature of the process of this invention that a positive withdrawal of water from the settling zone intermittently (rather than continuously) during the period in which the first valve is open permits satisfactory operation with substantially decreased quantities of withdrawn water. It will be found that operation in the intermittent mode may be carried out using only 5%–75%, say 10% as much water as would be required for continuous operation i.e. with a continuous stream of withdrawn water passing through the valve during the entire time that the first valve is open i.e. during the valve-open period.

It is a further advantage of the process of this invention that, when the water is recycled from the lock hopper to the settling zone during the valve-open period, the amount of cooling of the recycled water is less; and this makes it possible to decrease the size of the cooler in the recycle circuit- and in some cases to eliminate this cooler.

It is also a feature of this invention in one of its aspects that a portion of the water withdrawn from the lock hopper may be cooled and returned to the lock hopper, this being done in order to maintain the water in the lock hopper at temperature below its flash point at the pressure of operation, including the lock hopper pressure when discharging the ash for removal, which is typically atmospheric pressure.

DESCRIPTION OF THE DRAWINGS

The drawing shows a schematic vertical section of a preferred embodiment of this invention illustrating a generator and associated therewith a quench chamber and lock hopper.

DESCRIPTION OF PREFERRED EMBODIMENTS

Practice of this invention will be apparent to those skilled in the art from the following.

EXAMPLE I

In this Example which represents the best mode of practicing the invention known at this time, there is provided a reaction vessel 11 having a refractory lining 12 and inlet nozzle 13. The reaction chamber 15 has an outlet portion 14 which includes a narrow throat section 16 which feeds into opening 17. Opening 17 leads into first contacting zone 18 inside of dip tube 21. The lower extremity of dip tube 21, which bears serrations 23, is immersed in bath 22 of quench liquid. The quench chamber 19 includes, preferably at an upper portion thereof, a gas discharge conduit 20.

A quench ring 24 is mounted at the upper end of dip tube 21. This quench ring may include an upper surface 26 which preferably rests against the lower portion of the lining 12 of vessel 11. A lower surface 27 of the quench ring preferably rests against the upper extremity of the dip tube 21. The inner surface 28 of the quench ring may be adjacent to the edge of opening 17.

Quench ring 24 includes outlet nozzles 25 which may be in the form of a series of holes or nozzles around the periphery of quench ring 24—positioned immediately adjacent to the inner surface of dip tube 21. The liquid projected through passageways or nozzles 25 passes in a direction generally parallel to the axis of the dip tube 21 and forms a thin falling film of cooling liquid which descends on the inner surface of dip tube 21. This falling film of cooling liquid forms an outer boundary of the first contacting zone.

At the lower end of the first contacting zone 18, there is a second contacting zone 30 which extends downwardly toward serrations 23 and which is also bounded by that portion of the downwardly descending film of cooling liquid which is directed towards the wall on the lower portion of dip tube 21.

The solids, including particles of ash, char, and unconverted fuel which are removed from the gas by contact with the water in bath 22 accumulate and collect in settling zone 36 in the lower portion of the body of liquid 22. For one minute during an operating cycle, valve 37 is closed and the particles are maintained in the settling zone. For 19 minutes during a valve-open period, valve 37 is opened and the particles pass downwardly through the valve 37 and the connecting passageway 38 to lock hopper 39. During the time that particles are passing downwardly into lock hopper 39, discharge valve 40 is closed.

In practice of the process of this invention according to the best mode, water at 150° F. is withdrawn from lock hopper 39 through conduit 42 and passed through heat exchanger 43 cooled by cooling water from line 44. The water now cooled to 120° F. is passed by pump 45 through line 46 and valve 47 to a point in the settling zone 36 just above the upper level of the body of deposited ash in the lower portion thereof. The water admitted through line 46 recirculates through valve 37 and line 38 to lock hopper 39 at 300° F. after some mixing with the main body of water 22 at 500° F.

It is a feature of the process of this invention that flow through pump 45 and line 46 (in this best mode) is regulated, by means well known to those skilled in the art, in an intermittent manner (i.e. in manner to yield a flow of water which varies over the course of time). In this preferred embodiment, during the valve-open period during which valve 37 is open, (19 minutes) the flow of water leaving the pump through line 46 is maintained in accordance with a square wave function i.e. for 3.8 minutes (starting from time zero when the valve 37 is first opened), the flow of water through line 46 to settling zone 36 is zero. At a time of 3.8 minutes, the flow of water is increased to 10 feet per minute (as measured in line 38, the narrow valved passageway). At a time of 4.75 minutes, the flow of water is decreased to zero; and the cycle is started again and continues during the total time of 19 minutes during which valve 37 is open.

It is a feature of this embodiment of the process of this invention that if desired the flow of water leaving lock hopper 39 through line 42 may be passed through line 48 by opening valve 49. This may be done preferably after the cycle which passes water into the settling zone 36 is completed and valve 47 is closed. In this manner, it is possible to cool the water in lock hopper 39 to below 212° F. so that when the contents of lock hopper 39 are withdrawn through line 41 by opening valve 40 (valve 37 being closed at this time), these contents may be readily removed therefrom with minimum flashing.

It is a feature of the process of this invention that the use of intermittent positive passage of water from the settling zone 36 to the lock hopper 39 during the time that valve 37 is open permits attainment of advantages not attainable by the use of a continuous non-positive recirculation of water such as is disclosed e.g. in U.S. Pat. No. 3,018,174.

The principal advantage is that by reducing the amount of water recycled, the heat efficiency of the system is improved. This is because the colder recycle water, when mixing with the hot water in and above the settling zone, undesirably cools the zone and gas leaving the quench zone. By cooling the gas, the amount of high level heat which is later recovered, as steam, is reduced.

Another advantage is that it is possible to reduce the size of cooler 43 and the cooling water rate admitted thereto through line 44. In some cases, by the use of the intermittent positive flow herein disclosed, it may be possible to eliminate the cooler completely i.e. the amount of hot water passed from the settling zone to the lock hopper may be decreased to a point at which cooling the water in the lock hopper may be unnecessary.

It is unexpectedly found that the use of intermittent positive flow makes it possible to minimize blockage in the lower portion of settling zone 36, valve 37, and passageway 38 with a water circulation rate which may be only 20% (or less) of that employed in a continuous flow mode.

It is also found that because of the intermittent introduction of cool water through line 46, it desirably fails to mix completely with the main body of water in the lower portion of the settling zone 36. Thus the stream of liquid and solids passing through valve 37 and passageway 38 may be at 300° F. which is desirably substantially cooler than the 500° F. temperature measured in the body of liquid 22 (which latter temperature is essentially the equilibrium temperature of water-steam at the 900 psig pressure of operation).

EXAMPLE II

In operation of the process of this invention utilizing the preferred embodiment of the apparatus of FIG. 1, there is admitted through inlet nozzle 13, a slurry containing 100 parts per unit time (all parts are by weight unless otherwise specifically stated) of charge coal and 60 parts of water. This charge coal is characterized as follows:

TABLE

| Component | WEIGHT % (dry) |
|---|---|
| Carbon | 67.6 |
| Hydrogen | 5.2 |
| Nitrogen | 3.3 |
| Sulfur | 1.0 |
| Oxygen | 11.1 |
| Ash | 11.8 |

There are also admitted 90 parts of oxygen of purity of 99.5 v %. Combustion in chamber 15 raises the temperature to 2500° F. at 900 psig. Product synthesis gas, passed through outlet portion 14 and throat section 16, may contain the following gaseous components:

TABLE

| | Volume % | |
|---|---|---|
| Component | Wet Basis | Dry Basis |
| CO | 35.7 | 44.7 |
| $H_2$ | 28.5 | 35.7 |
| $CO_2$ | 14.4 | 18 |
| $H_2O$ | 20 | — |
| $H_2O$ + COS | 0.9 | 1.1 |
| $N_2$ + Argon | 0.4 | 0.5 |
| $CH_4$ | 0.08 | 0.1 |

This synthesis gas may also contain about 4.1 pounds of solid (char and ash) per 1000 SCF dry gas.

The product synthesis gas (235 parts) leaving the throat section 16 passes through opening 17 in the quench ring 24 into first contacting zone 18. Aqueous cooling liquid at 420° F. is admitted through inlet line 34 to quench ring 24 from which it exits through outlet nozzles 25 as a downwardly descending film on the inner surface of dip tube 21 which defines the outer boundary of first contacting zone 18. As synthesis gas, entering the first contacting zone at about 2500° F., passes downwardly through the zone 18 in contact with the falling film of aqueous cooling liquid, it is cooled to about 2150° F.-2200° F.

The so-cooled synthesis gas is then admitted to the second contacting zone 30. It passes under serrated edge 23 into contact with the body 22 of liquid. Although the drawing shows a static representation having a delineated "water-line", it will be apparent that in operation, the gas and the liquid in the second contacting zone will be in violent turbulence as the gas passes downwardly through the body of liquid, leaves the dip tube 21 passing serrated edge 23 thereof, and passes upwardly through the body of liquid outside the dip tube 21. The area between the outside surface of the dip tube and the inside surface of the vessel 19, defines a third contacting zone. The inlet temperature to this zone may be 800° F. and the outlet temperature 500° F.

The further cooled synthesis gas, during its contact with cooling liquids loses at least a portion of its solids content. Typically the further cooled synthesis gas containing a decreased content of ash particles leaving the body of liquid 22 in second contacting zone 30 contains solids (including ash and char) in amount of about 0.6 pounds per 1000 SCF dry gas.

The exiting gas at 500° F. is withdrawn from the cooling system through gas discharge conduit 20; and it commonly passes through a venturi thereafter wherein it may be mixed with further cooling liquid for additional cooling and/or loading with water. This venturi is preferably immediately adjacent to the outlet nozzle.

The solids which accumulate in the lower portion 36 of the body of liquid 22 at 500° F., are withdrawn by opening valve 37 for a valve-open time of 19 minutes (during a cycle which includes a shut time of 1 minute). The solids in lower portion of the settling zone 36 pass through open valve 37 and passageway 38 into lock hopper 39 wherein the particles settle to the lower portion thereof and the liquid collects as a supernatant body at 160° F.

In this embodiment, this supernatant body of liquid is intermittently withdrawn (during the period in which the valve 37 is open) from lock hopper 39 through line 42 and cooled in heat exchanger 43 to 150° F. It is then passed intermittently through pump 45 through line 46 and valve 47 to vessel 19. The intermittent cycle in this embodiment includes a square wave cycle in which water is passed at a high constant rate of 50 parts per unit time for 1 minute followed by period of 4 minutes during which the flow of water is zero, the cycle then being repeated. A draw-off stream of 25 parts per unit time passes through valve 49 and line 48 to lock hopper 39, this stream serving to cool the liquid in the lock hopper.

Although this invention has been illustrated by reference to specific embodiments, it will be apparent to those skilled in the art that various changes and modifications may be made which clearly fall within the scope of this invention.

What is claimed is:

1. A process for the production of synthesis gas from an ash-containing carbonaceous fuel which comprises gasifying said fuel in finely divided form in a gasification zone at superatmospheric pressure to produce a product synthesis gas containing particles of ash and unconverted fuel;

passing said particles of ash and unconverted fuel into water contained in a settling zone and in a lock hopper having a narrow valved connecting passageway therebetween, said ash and unconverted fuel during settling tending to collect in the lower portion of the settling zone and to block the passageway and thereby prevent the passage of said particles of ash and uncoverted fuel from the lower portion of said settling zone into said passageway and thence into said lock hopper;

intermittently opening the valve in said connecting passageway thereby permitting the particles to pass through said valved passageway during a valve-open period; and intermittently during said valve-open period, applying force in addition to gravity for positively passing water through said valve from said settling zone into said lock hopper at a pressure higher than that in the lock hopper in order to increase the flow of water leaving the lower portion of said settling zone, passing through said valved passageway, and entering said lock hopper, thereby increasing the velocity and quantity of water passing through said valved passageway whereby positive flow of said particles is effected through said passageway during the valve-open period in which said valve in said valved passageway is open.

2. A process as claimed in claim 1 wherein the water balance is maintained by externally recycling water from said lock hopper to said settling zone during said valve-open period.

3. A process as claimed in claim 1 wherein said valve-open period is 50%–95% of the total time.

4. A process as claimed in claim 2 wherein said recycled water is cooled prior to entry into said settling zone.

5. A process as claimed in claim 1 wherein a portion of the water in said lock hopper is withdrawn, cooled, and returned to said lock hopper whereby the water in said lock hopper is maintained at temperature below the flash temperature at the pressure in said lock hopper.

6. A process for the production of synthesis gas from an ash-containing carbonaceous fuel which comprises gasifying said fuel in finely divided form in a gasification zone at superatmospheric pressure to produce a product synthesis gas containing particles of ash and unconverted fuel;

passing said particles of ash and unconverted fuel into water contained in a settling zone and in a lock hopper having a narrow valved connecting passageway therebetween, said ash and unconverted fuel during settling tending to collect in the lower portion of the settling zone and to block the passageway and thereby prevent the passage of said particles of ash and unconverted fuel from the lower portion of said settling zone into said passageway and thence into said lock hopper;

intermittently opening the valve in said connecting passageway for 50%–95% of the total time thereby permitting the particles to pass through said valved passageway during a valve-open period;

intermittently, during said valve-open period, applying force in addition to gravity for positively passing water through said valve from said settling zone into said lock hopper at a pressure higher than that in the lock hopper in order to increase the flow of water leaving the lower portion of said settling zone, passing through said valved passageway, and entering said lock hopper, thereby increasing the velocity and quantity of water passing through said valved passageway whereby positive flow of said particles is effected through said passageway during the valve-open period in which said valve in said valved passageway is open; and maintaining the water balance by externally recycling water from said lock hopper to said settling zone during said valve-open period.

* * * * *